US008978833B2

(12) United States Patent
Suzuki

(10) Patent No.: US 8,978,833 B2
(45) Date of Patent: Mar. 17, 2015

(54) DOUBLE-DECK ELEVATOR GROUP CONTROLLER

(75) Inventor: Naohiko Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 617 days.

(21) Appl. No.: 13/392,553

(22) PCT Filed: Nov. 9, 2009

(86) PCT No.: PCT/JP2009/005940
§ 371 (c)(1),
(2), (4) Date: Feb. 27, 2012

(87) PCT Pub. No.: WO2011/055414
PCT Pub. Date: May 12, 2011

(65) Prior Publication Data
US 2012/0152661 A1 Jun. 21, 2012

(51) Int. Cl.
*B66B 1/18* (2006.01)
*B66B 1/24* (2006.01)

(52) U.S. Cl.
CPC ..... *B66B 1/2458* (2013.01); *B66B 2201/103* (2013.01); *B66B 2201/211* (2013.01); *B66B 2201/213* (2013.01); *B66B 2201/214* (2013.01); *B66B 2201/306* (2013.01); *B66B 2201/403* (2013.01); *Y10S 187/902* (2013.01)
USPC ..... 187/382; 187/902

(58) Field of Classification Search
USPC ..... 187/247, 380–389, 391, 393, 396, 902
See application file for complete search history.

(56) References Cited

U.S. PATENT DOCUMENTS

| | | | | |
|---|---|---|---|---|
| 3,493,922 | A | 2/1970 | Laas | |
| 3,625,311 | A | 12/1971 | Nowak et al. | |
| 4,582,173 | A * | 4/1986 | Schroder | 187/387 |
| 5,086,883 | A * | 2/1992 | Schroder | 187/258 |
| 5,844,179 | A * | 12/1998 | Walker et al. | 187/382 |

(Continued)

FOREIGN PATENT DOCUMENTS

| | | |
|---|---|---|
| CN | 1498844 A | 5/2004 |
| JP | 3073650 | 8/2000 |

(Continued)

OTHER PUBLICATIONS

Japanese Office Action issued Jun. 18, 2013 in Patent Application No. 2011-539185 with Partial English Translation.
Chinese Office Action issued May 27, 2014 in Patent Application No. 200980162201.9 with Partial English Translation.
Chinese Office Action issued Oct. 21, 2013, in China Patent Application No. 200980162201.9 (with English translation).
International Search Report Issued Jan. 12, 2010 in PCT/JP09/05940 Filed Nov. 9, 2009.
Extended European Search Report issued Nov. 17, 2014 in Patent Application No. 09851070.4.

*Primary Examiner* — Anthony Salata
(74) *Attorney, Agent, or Firm* — Oblon, McClelland, Maier & Neustadt, L.L.P.

(57) ABSTRACT

A double-deck elevator group controller including a hall-installed car call registration device, cars of the first operation mode which are in charge of operation between even-numbered floors or between odd-numbered floors and cars of the second operation mode which serve all of the floors at which the cars can stop, are set, and in consideration of both combinations of boarding and alighting floors of registered from-hall car calls and an increment of the number of stops, the from-hall car calls are divided for assignment to the cars of the first operation mode and the cars of the second operation, whereby it is possible to meet from-hall car calls having arbitrary floors as the boarding and alighting floors and it is possible to improve the operation efficiency.

8 Claims, 4 Drawing Sheets

(56) References Cited

U.S. PATENT DOCUMENTS

| | | | | |
|---|---|---|---|---|
| 5,861,587 | A * | 1/1999 | Powell et al. | 187/382 |
| 6,176,351 | B1 * | 1/2001 | Ikeda et al. | 187/387 |
| 6,237,721 | B1 * | 5/2001 | Siikonen | 187/382 |
| 6,293,368 | B1 * | 9/2001 | Ylinen et al. | 187/382 |
| 6,419,051 | B2 * | 7/2002 | Mori et al. | 187/382 |
| 6,505,712 | B2 * | 1/2003 | Hattori et al. | 187/382 |
| 6,508,333 | B2 * | 1/2003 | Kostka et al. | 187/382 |
| 7,694,781 | B2 * | 4/2010 | Sorsa et al. | 187/382 |
| 8,387,756 | B2 * | 3/2013 | Laihanen et al. | 187/387 |
| 2014/0041968 | A1 * | 2/2014 | Tokura | 187/389 |

FOREIGN PATENT DOCUMENTS

| | | |
|---|---|---|
| JP | 2002 60149 | 2/2002 |
| JP | 2004-277177 A | 10/2004 |
| JP | 3807682 | 8/2006 |

* cited by examiner

FIG. 1

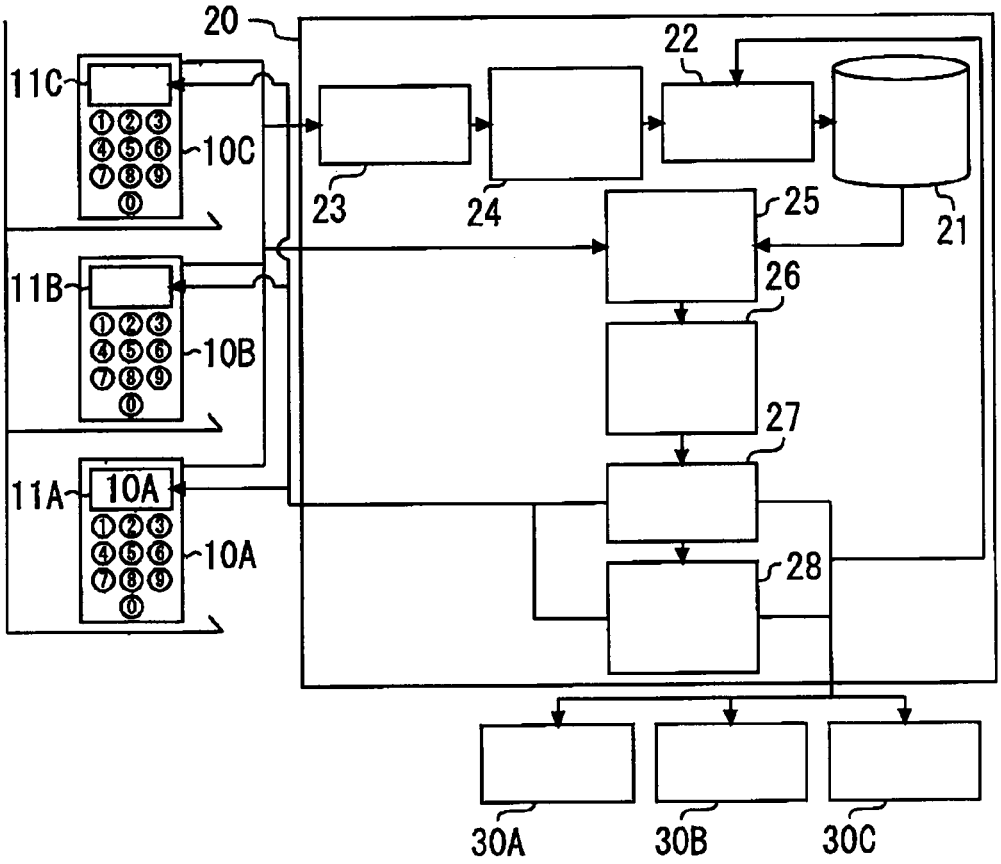

20:ELEVATOR GROUP COTROLLER
21:OPERATION MODE STORAGE MEANS
22:OPERATION MODE SETTING MEANS
23:TRAFFIC FLOW DETECTION MEANS
24:MEANS FOR CHANGING THE NUMBER OF CARS HAVING A SET OPERATION MODE
25:FROM-HALL CAR-CALL ASSIGNED CANDIDATE CAR SELECTION MEANS
26:ASSIGNED CANDIDATE CARS OBTAINED FROM THE ASSIGNED CANDIDATE CAR SELECTION
27:ASSIGNED CAR SELECTION MEANS
28:MEANS FOR SELECTING ASSIGNED CARS OF THE SECOND OPERATION MODE
30A-30C: EACH-CAR CONTROLLER

DOUBLE-DECK ELEVATOR GROUP CONTROLLER

TECHNICAL FIELD

The present invention relates to an elevator group controller which controls the operation of a plurality of cars of a double-deck elevator system having cars vertically connected to each other in the same shaft.

BACKGROUND ART

Reports on double-deck elevators vertically connected to each other in one shaft have hitherto been made, and usually group control is performed in the case where a plurality of double-deck elevators are installed side by side. In usual double-deck elevators, for example, an escalator is installed nearby, whereby in departure floors (for example, the first floor and the second floor), passengers are guided in appropriately selecting either the upper car or the lower car according to destination floors; for example, passengers who want to go to odd-numbered floors board the lower car from the first floor and passengers who want to go to even-numbered floors go to the second floor using the escalator and board the upper car from the second floor.

On the other hand, on ordinary floors, there is adopted a method which involves selecting one elevator according to car calls and assigning the elevator instead of guiding passengers in appropriately selecting either the upper or the lower car.

In general, for a double-deck elevator, the following three kinds of operation methods are provided and the operation methods are switched according to the traffic volume:

(1) Double method: The upper car serves only even-numbered floors and the lower car serves only the odd-number floors. Carried out at peak times.

(2) Single method: The upper car is closed, and all floors are served by the lower car alone. Carried out at off-peak times.

(3) Semi-double method: This method is the same as the double method on departure floors. After a response to a from-hall car call, both the upper car and the lower car serve arbitrary floors. Carried out in normal times.

In an elevator group controller which controls the operation of a plurality of cars of a conventional double-deck elevator system, there are provided a first operation mode (the double method) in which the upper car responds to from-hall car calls from even-numbered floors to even-numbered floors and the lower car responds to from-hall car calls from odd-numbered floors to odd-numbered floors and a second operation mode (the single method) in which from-hall car calls from even-numbered floors to odd-numbered floors or from odd-numbered floors to even-numbered floors are responded to, and on the basis of the information on from-hall car calls classified according to the even-numbered floors and odd-numbered floors which are registered by from-hall car call registration devices provided separately for even-numbered destination floors and odd-numbered destination floors, such as Go up to even-numbered floors and Go up to odd-numbered floors, installed in a hall, a decision is made as to which of the cars of the first operation mode or cars of the second operation mode should be assigned cars (for example, Patent Literature 1).

CITATION LIST

Patent Literature

Patent Literature 1: Japanese Patent Laid-Open No. 2002-60149

SUMMARY OF INVENTION

Technical Problem

In a conventional double-deck elevator group controller, cars are divided into the cars of a first operation mode which respond to from-hall car calls in which a combination of boarding and alighting floors is for the operation between even-numbered floors and the operation between odd-numbered floors and the cars of a second operation mode which respond to from-hall car calls in which a combination of boarding and alighting floors is for the movement from an even-numbered floor to an odd-numbered floor or for the movement from an odd-numbered floor to an even-numbered floor. However, this conventional double-deck elevator group controller has the problems such as a low degree of freedom in car operation, for example, it is impossible to assign from-hall car calls for the operation between even-numbered floors and for the operation between odd-numbered floors to the cars of the second operation mode, with the result that the operation efficiency decreases. For example, in the conventional double-deck elevator group controller, when a from-hall car call from 6F to 12F occurs in the case where from-hall car calls from 5F to 8F and from 8F to 11F are assigned to an under-car car of the second operation mode, an assigned car is selected from the cars of the first operation mode. However, if in this case an above-car car of the second operation mode is assigned, the operation efficiency is high because the number of stops does not increase, but this cannot be coped with by the conventional double-deck elevator group controller, thus posing another problem.

Means for Solving the Problems

A double-deck elevator group controller which controls the operation of a plurality of cars of an elevator system having cars vertically connected to each other in the same shaft in the present invention includes a hall-installed destination floor input device 10 which is installed in a hall of each floor, by use of which a passenger registers a from-hall car call by inputting his or her destination floor, operation mode storage means 21 which stores, for each car of the plurality of connected cars, two operation modes: a first operation mode in which an upper car of the connected cars serves an upper lobby floor and even-numbered service floors and a lower car of the connected cars serves a lower lobby floor and odd-numbered service floors and a second operation mode in which the upper car and lower car of the connected cars serve all floors at which the cars can stop, from-hall car-call assigned candidate car selection means 25 which, upon registration of a from-hall car call by the hall-installed destination floor input device, regards a car whose operation mode is the first operation mode as an assigned candidate car for the from-hall car call when a combination of boarding and alighting floors of the from-hall car call corresponds to any one of operation between an upper lobby floor and an even-numbered service floor, operation between an even-numbered service floor and an even-numbered service floor, operation between a lower lobby floor and an odd-numbered service floor and operation between an odd-numbered service floor and an odd-numbered service floor and a minimum value of an increment of the number of stops obtained when the from-hall car call is assigned to a car of the first operation mode is not more than or less than a minimum value of an increment of the number of stops obtained when the from-hall car call is assigned to a car of the second operation mode.

A double-deck elevator group controller which controls the operation of a plurality of cars of an elevator system having cars vertically connected to each other in the same shaft in the present invention includes a hall-installed destination floor input device 10 which is installed in a hall of each floor, by use of which a passenger registers a from-hall car call by inputting his or her destination floor, operation mode storage means 21 which stores, for each car of the plurality of connected cars, two operation modes: a first operation mode in which an upper car of the connected cars serves an upper lobby floor and even-numbered service floors and a lower car of the connected cars serves a lower lobby floor and odd-numbered service floors and a second operation mode in which the upper car and lower car of the connected cars serve all floors at which the cars can stop and from-hall car-call assigned candidate car selection means 25 which, upon registration of a from-hall car call by the hall-installed destination floor input device, regards a car whose operation mode is the second operation mode as an assigned candidate car for the from-hall car call when a combination of boarding and alighting floors of the from-hall car call corresponds to operation between an even-numbered service floor and an odd-numbered service floor, or when a combination of boarding and alighting floors of the from-hall car call corresponds to operation between an even-numbered service floor and an even-numbered service floor and operation between an odd-numbered service floor and an odd-numbered service floor and a minimum value of an increment of the number of stops obtained when the from-hall car call is assigned to a car of the second operation mode is less than a minimum value of an increment of the number of stops obtained when the from-hall car call is assigned to a car of the first operation mode.

A double-deck elevator group controller of the present invention regards a car whose operation mode is the second operation mode as an assigned candidate car for the from-hall car call in the from-hall car-call assigned candidate car selection means 25, even when a combination of boarding and alighting floors of the from-hall car call corresponds to either operation between an upper lobby floor and an odd-numbered service floor or operation between an lower lobby floor and an even-numbered service floor.

A double-deck elevator group controller of the present invention includes means for changing the number of cars having a set operation mode 24 which increases the number of cars on a scheduled path for a run in the ascending direction for which the first operation mode is set in the operation mode storage means when at least either the number of passengers or the ratio of the number of passengers in the ascending direction who board a car from at least either an upper lobby floor or a lower lobby floor is not less than respective prescribed limited values or when a time zone set beforehand is matched.

A double-deck elevator group controller of the present invention includes means for changing the number of cars having a set operation mode 24 which increases the number of cars for which the first operation mode is set on a path scheduled for a run in the descending direction in the operation mode storage means when at least either the number of passengers or the ratio of the number of passengers in the descending direction who board cars from at least either an upper lobby floor or a lower lobby floor is not less than respective prescribed limited values or when a time zone set beforehand is matched.

A double-deck elevator group controller of the present invention includes means for selecting assigned candidate cars in terms of the number of stops 26 which excludes cars whose number of stops on the scheduled path for a run to which the from-hall car call belongs is not less than a prescribed upper limit or larger than the prescribed upper limit from assigned candidate cars when a from-hall car call inputted by the above-described hall-installed car-call input device is assigned to an assigned candidate car of the first operation mode or the second operation mode.

A double-deck elevator group controller of the present invention includes assigned car selection means 27 which preferentially selects, in assigned candidate cars obtained from the assigned candidate car selection means 26, cars whose increment value of the number of stops is small as assigned cars when the from-hall car call inputted by the above-described hall-installed car-call input device is assigned, and selects, in assigned candidate cars obtained from the assigned candidate car selection means 26, a car whose increment value of the sum of waiting time obtained when the from-hall car call is assigned or whose increment value of the sum of total traveling time from the arrival at the hall to the alighting at the destination floor becomes a minimum as an assigned car in the case where there are plurality of cars having the same increment value of the number of stops.

A double-deck elevator group controller of the present invention includes means for selecting assigned cars of the second operation mode 28 which assigns a prescribed car which is either the upper car or the lower car to the from-hall car call when the assigned car selected by the assigned car selection means is a car of the second operation mode and the increment value of the number of stops by the above-described assigned car is 2.

Advantageous Effects of Invention

In the double-deck elevator group controller of the present invention, when a combination of boarding and alighting floors of a new from-hall car call corresponds to any one of the operation between an upper lobby and an even-numbered service floor, the operation between an even-numbered service floor and an even-numbered service floor, the operation between a lower lobby floor and an odd-numbered service floor and the operation between an odd-numbered service floor and an odd-numbered service floor, and a minimum value of an increment of the number of stops obtained when a from-hall car call is assigned to a car of the first operation mode is not more than or less than a minimum value of an increment of the number of stops obtained when a from-hall car call is assigned to a car of the second operation mode, a car whose operation mode is the first operation mode is regarded as an assigned candidate car for the from-hall car call. Therefore, the double-deck elevator group controller of the present invention has the advantageous effect that the operation efficiency is increased.

And in the double-deck elevator group controller of the present invention, when a combination of boarding and alighting floors of a new from-hall car call corresponds to the operation between an even-numbered service floor and an odd-numbered service floor, or when a combination of boarding and alighting floors of a from-hall car call corresponds to the operation between an even-numbered service floor and an even-numbered service floor and the operation between an odd-numbered service floor and an odd-numbered service floor and a minimum value of an increment of the number of stops obtained when the from-hall car call is assigned to a car of the second operation mode is less than a minimum value of an increment of the number of stops obtained when the from-hall car call is assigned to a car of the first operation mode, a car whose operation mode is the second operation mode is regarded as an assigned candidate car for the above-described from-hall car call. Therefore, it is possible to provide service to a from-hall car call having an arbitrary floor as boarding and alighting floors and the double-deck elevator group controller of the present invention has the advantageous effect that the degree of freedom in car operation increases and the operation efficiency increases.

Furthermore, in the double-deck elevator group controller of the present invention, even when a combination of boarding and alighting floors of a new from-hall car call corresponds to either the operation between an upper lobby floor and an odd-numbered service floor or the operation between an lower lobby floor and an even-numbered service floor, a car whose operation mode is the second operation mode is regarded as an assigned candidate car for the above-described from-hall car call. Therefore, it is possible to provide service to a from-hall car call having an arbitrary floor as boarding and alighting floors and the double-deck elevator group controller of the present invention has the advantageous effect that the degree of freedom in car operation increases and the operation efficiency increases.

Moreover, in the double-deck elevator group controller of the present invention, when at least either the number of passengers or the ratio of the number of passengers in the ascending direction who board a car from at least either an upper lobby floor or a lower lobby floor is not less than respective prescribed limited values or when a time zone set beforehand is matched, the number of cars on a path scheduled for a run in the ascending direction for which the first operation mode is set is increased in the above-described operation mode storage means. Therefore, the present invention has the advantageous effect that the degree of freedom in car operation increases and the operation efficiency increases.

In the double-deck elevator group controller of the present invention, at least either the number of passengers or the ratio of the number of passengers in the descending direction who alight from cars on at least either an upper lobby floor or a lower lobby floor is not less than respective prescribed limited values or when a time zone set beforehand is matched, the number of cars on a scheduled path for a run in the descending direction for which the first operation mode is set is increased in the above-described operation mode storage means. Therefore, the present invention has the advantageous effect that the degree of freedom in car operation increases and the operation efficiency increases.

And in the double-deck elevator group controller of the present invention, when a from-hall car call inputted by the above-described hall-installed car-call input device is assigned to an assigned candidate car of the first operation mode or the above-described second operation mode, cars whose number of stops on the scheduled path for a run to which the above-described from-hall car call belongs is not less than a prescribed upper limit or larger than the prescribed upper limit, are excluded from assigned candidate cars. Therefore, the present invention has the advantageous effect that the operation efficiency increases.

Furthermore, in the double-deck elevator group controller of the present invention, in assigned candidate cars obtained from the assigned candidate car selection means, cars whose increment value of the number of stops is small are preferentially selected as assigned cars when the from-hall car call inputted by the above-described hall-installed car-call input device is assigned, and in the case where there are plurality of cars having the same increment value of the number of stops, a car whose increment value of the sum of waiting time obtained when the from-hall car call is assigned or whose increment value of the sum of total travel time from the arrival at the hall to the alighting at the destination floor becomes a minimum is selected as an assigned car. Therefore, the present invention has the advantageous effect that the operation efficiency increases.

Moreover, in the double-deck elevator group controller of the present invention, when the assigned car selected by the assigned car selection means is a car of the second operation mode and the increment value of the number of stops by the above-described assigned car is 2, a prescribed car which is either the upper car or the lower car is assigned to the from-hall car call. Therefore, the present invention has the advantageous effect that the operation efficiency increases.

BRIEF DESCRIPTION OF THE DRAWINGS

FIG. 1 shows a configuration diagram of a double-deck elevator group controller in Embodiment 1 of the present invention.

DESCRIPTION OF EMBODIMENTS

Embodiment 1

FIG. 1 shows a double-deck elevator group controller in Embodiment 1 of the present invention. In FIG. 1, a new from-hall car call inputted from the numerical-key of any of the hall-installed car call registration devices 10A to 10C installed in the hall of each floor is transmitted to an elevator group controller 20.

Next, from-hall car-call assigned candidate car selection means 25 refers to the combinations of boarding floors and alighting floors of the new from-hall car call and makes determination about to which of (1) in front of the path on which the car is presently running and in the same direction (hereinafter referred to as the 1st path), (2) in the direction reverse to the path on which the car is presently running (hereinafter referred to as the 2nd path), and (3) behind the path on which the car is presently running and in the same direction (hereinafter referred to as the 3rd path) the scheduled path of each car for a run belongs.

Figure 2:
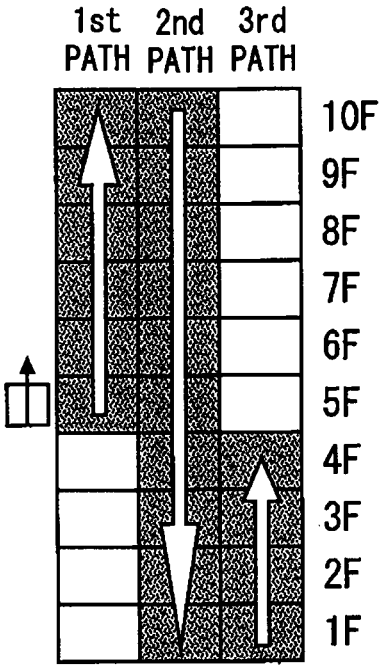
FIG. 2 shows examples of the scheduled path in Embodiment 1 of the present invention.

FIG. 2 shows examples of the scheduled path of each car for a run on the 1st path, the 2nd path and the 3rd path. When a car is presently ascending in 5F, the 1st path is used in the case where the boarding floors of a from-hall car call are 5F to 10F and the direction of the from-hall car call is the ascending direction, the 2nd path is used in the case where the direction of the from-hall car call is the descending direction, and the 3rd path is used in the case where the boarding floors of a from-hall car call are 1F to 4F and the direction of the from-hall car call is the ascending direction.

The from-hall car-call assigned candidate car selection means 25 takes out cars of the first operation mode and cars of the second operation mode in any scheduled path for a run of the 1st path, the 2nd path or the 3rd path to which a new from-hall car call belongs from operation mode storage means 21. In taking out cars from the operation mode storage means 21, cars which are set for neither the first operation mode nor the second operation mode and cars for which a from-hall car call is not assigned to the scheduled path for a run in question are added to both cars of the first operation mode and cars of the second operation mode.

In the cars of the first operation mode, an upper car of connected cars performs operation to serve an upper lobby floor (a floor at which the upper car of a double deck stops, for example: the second floor) and an even-numbered service floor and a lower car of connected cars performs operation to serve a lower lobby floor (a floor at which the lower car of a double deck stops, for example: the first floor) and an odd-numbered service floor. In the cars of the second operation mode, an upper car and a lower car of connected cars perform operation to serve all of the floors at which the cars can stop. The two operation modes are such that each time the direction is reversed, operation of different mode may be performed.

Minimum values of the increment of the number of stops obtained when a new from-hall car call is assigned to a car of the first operation mode and a car of the second operation mode are respectively computed. On this occasion, the increment values of the number of stops are computed for the case where the from-hall car call is assigned to both the upper car and the lower car.

Determination is made as to under which of the following classes (1) to (4) a combination of boarding and alighting floors of the new from-hall car call falls:

(1) The operation between an upper lobby and an even-numbered service floor (2) The operation between an even-numbered service floor and an even-numbered service floor (3) The operation between a lower lobby floor and an odd-numbered service floor (4) The operation between an odd-numbered service floor and an odd-numbered service floor Cars of the first operation mode are regarded as assigned candidate cars in the case where a combination of boarding and alighting floors of a new from-hall car call corresponds to (1) to (4) above and a minimum value of an increment of the number of stops obtained when the from-hall car call is assigned to a car of the first operation mode is not more than or less than a minimum value of an increment of the number of stops obtained when the from-hall car call is assigned to a car of the second operation mode. This is because when combinations of boarding floors and alighting floors are (1) to (4), this case corresponds to the action of the double mode (the first operation mode), and in the case where a minimum value of an increment of the number of stops obtained when the from-hall car call is assigned to a car of the first operation mode is not more than or less than a minimum value of an increment of the number of stops obtained when the from-hall car call is assigned to a car of the second operation mode, the number of stops of the assigned car in the first operation mode does not increase and hence disadvantages due to the application of the first operation mode do not occur at all.

In cases other than the above-described case, cars of the second operation mode are regarded as assigned candidate cars.

Next, in means for selecting assigned candidate cars in terms of the number of stops 26, among assigned candidate cars obtained from the from-hall car-call assigned candidate car selection means 25, the scheduled number of stops on a scheduled path for a run to which a from-hall car call belongs is computed each for an upper car and a lower car, and the upper car or the lower car, whichever has a smaller number of stops and has the number of stops which is larger than an upper limit of number of stops of a car, which is set beforehand, is excluded from the assigned candidate cars. When there is no assigned candidate car, the upper limit of number of stops is increased by +1 and the conditions are relaxed until an assigned candidate car is obtained.

The upper limit value of number of stops which is set beforehand is computed using, for example, Formula (A) below:

$$\text{(Upper limit of number of stops)}=(F/N)+2 \qquad \text{Formula (A)}$$

where F is the number of floors, at which the car can stop, higher than the main floor (upper lobby floor (second floor), for the first operation mode, the number of even-numbered floors or the number of odd-numbered floors is set, and N is the total number of cars.

In the assigned car selection means 27, a car having a minimum increment of the number of stops obtained when a new from-hall car call is assigned is selected as an assigned car from the assigned candidate cars obtained from the means for selecting assigned candidate cars in terms of the number of stops 26. For the assignment of an upper car or a lower car, a car having a minimum increment of the scheduled number of stops is assigned. When the upper car and the lower car have the same increment of the scheduled number of stops, the upper car or lower car which is set beforehand is assigned. However, in the case where there are a plurality of cars having a minimum increment value of the number of stops, an increment value of waiting time in each hall is computed for each car having a minimum increment value of the number of stops and the sum of increment values of waiting time for each car is computed. A car having a minimum sum of increment values of waiting time is selected as an assigned car. Here, waiting time refers to the time from the registration of a call to the allocation of a car to a hall.

In the assigned car selection means 27, a car having a minimum sum of increment values of waiting time is selected as an assigned car. However, it is possible to select a car having a minimum sum of increment values of total traveling time as an assigned car. Here, the total traveling time refers to the time from the arrival of a passenger at a hall to the alighting at a destination floor and includes the time for the call registration in a hall, allocation of a car, door opening and closing in a hall, movement to a destination floor and door opening at an alighting floor.

When in means for selecting assigned cars of the second operation mode 28, an assigned car is classified as a car of the second operation mode by the assigned car selection means 27 and the increment of the number of stops by a new from-hall car call is +2, the upper car or the lower car, whichever is set beforehand, is regarded as an assigned car. Incidentally, that the increment of the number of stops is +2 corresponds to the fact that a new boarding floor or alighting floor is added.

In the assigned car selection means 27 or the means for selecting assigned cars of the second operation mode 28, assigned car machine numbers including selected upper and lower cars are transmitted to each-car controllers 30A to 30C of the machine number in question. The each-car controllers 30A to 30C of the machine number in question perform the run/stop control of each car according to the assigned car machine numbers including the upper and lower cars which have been transmitted.

In the assigned car selection means 27 or the means for selecting assigned cars of the second operation mode 28, assigned machine numbers are transmitted to the hall-installed car call registration devices 10A to 10C in which the from-hall car calls in question are registered. Assigned machine number indication devices for from-hall car call 11A to 11C installed in the hall-installed car call registration devices 10A to 10C in which the from-hall car calls in question are registered indicate the registered destination floors and assigned machine names.

Although the assigned machine number indication devices for from-hall car call 11A to 11C indicate the registered destination floors and assigned machine names, these devices can indicate the upper car and the lower car in addition to the assigned machine names.

Traffic flow detection means 23 totalizes the from-hall car calls inputted from the hall-installed car call registration devices 10A to 10C, and detects the present traffic flow type. Examples of typical traffic flow types which are detected include an up-peak traffic flow with many passengers moving in the ascending direction from a lobby floor, a down-peak traffic flow with many passengers moving in the descending direction from upper flowers to a lobby floor, and an off-time traffic flow with heavy traffic between upper floors except a lobby floor.

With the aid of the information on the traffic flow types detected by the traffic flow detection means 23, means for changing the number of cars having a set operation mode 24 performs the change of the number of cars for which the first operation mode is set and the number of cars for which the second operation mode is set for each scheduled path for a run.

When the traffic flow detection means 23 determines that the present traffic flow type is an up-peak traffic flow with many passengers moving in the ascending direction from a lobby floor, in order to improve the transportation capacity from a lobby floor to upper floors, the means for changing the number of cars having a set operation mode 24 sets, for example, the number of cars for which the first operation mode is set in scheduled paths for runs in the ascending direction and the descending direction at (total number of cars)−1 and the number of cars for which the second operation mode is set at 1. Also for a down-peak traffic flow with many passengers moving in the descending direction, the number of cars of the first operation mode and of the second operation mode is set in the same manner as with an up-peak traffic flow.

Also, when the traffic flow detection means 23 determines that the present traffic flow type is an off-time traffic flow with heavy traffic between upper floors, in order to improve the service between upper floors, the means for changing the number of cars having a set operation mode 24 sets, for example, the number of cars for which the first operation mode is set in scheduled paths for runs in the ascending direction and the descending direction at (total number of cars)/2 and the number of cars for which the second operation mode is set at (total number of cars)/2.

Operation mode setting means 22 sets the operation mode for each scheduled path for a run with the aid of the number of cars of the set first operation mode and the number of cars of the set second operation mode, which are obtained from the means for changing the number of cars having a set operation mode 24, as upper limits, and stores the operation mode in the operation mode storage means 21. For a scheduled path for a run to which no from-hall car call has been assigned as yet, the first operation mode is set in the case where the number of cars of the first operation mode is less than the number of cars of the set first operation mode and the number of cars of the second operation mode is not less than the number of cars of the set second operation mode, the second operation mode is set in the case where the number of cars of the first operation mode is not less than the number of cars of the set first operation mode and the number of cars of the second operation mode is less than the number of cars of the set second operation mode, and neither of the operation modes is set in the case where the number of cars of the first operation mode is less than the number of cars of the set first operation mode and the number of cars of the second operation mode is less than the number of cars of the set second operation mode.

Furthermore, in the case where a scheduled path for a run of a new from-hall car call in an assigned car obtained by the assigned car selection means 27 or the means for selecting assigned cars of the second operation mode belongs to neither the first operation mode nor the second operation mode, the operation mode setting means 22 sets the scheduled path for a run in question in assigned cars to either the first operation mode or the second operation mode according to a combination of a boarding floor and an alighting floor of the new from-hall car call.

Figure 3:
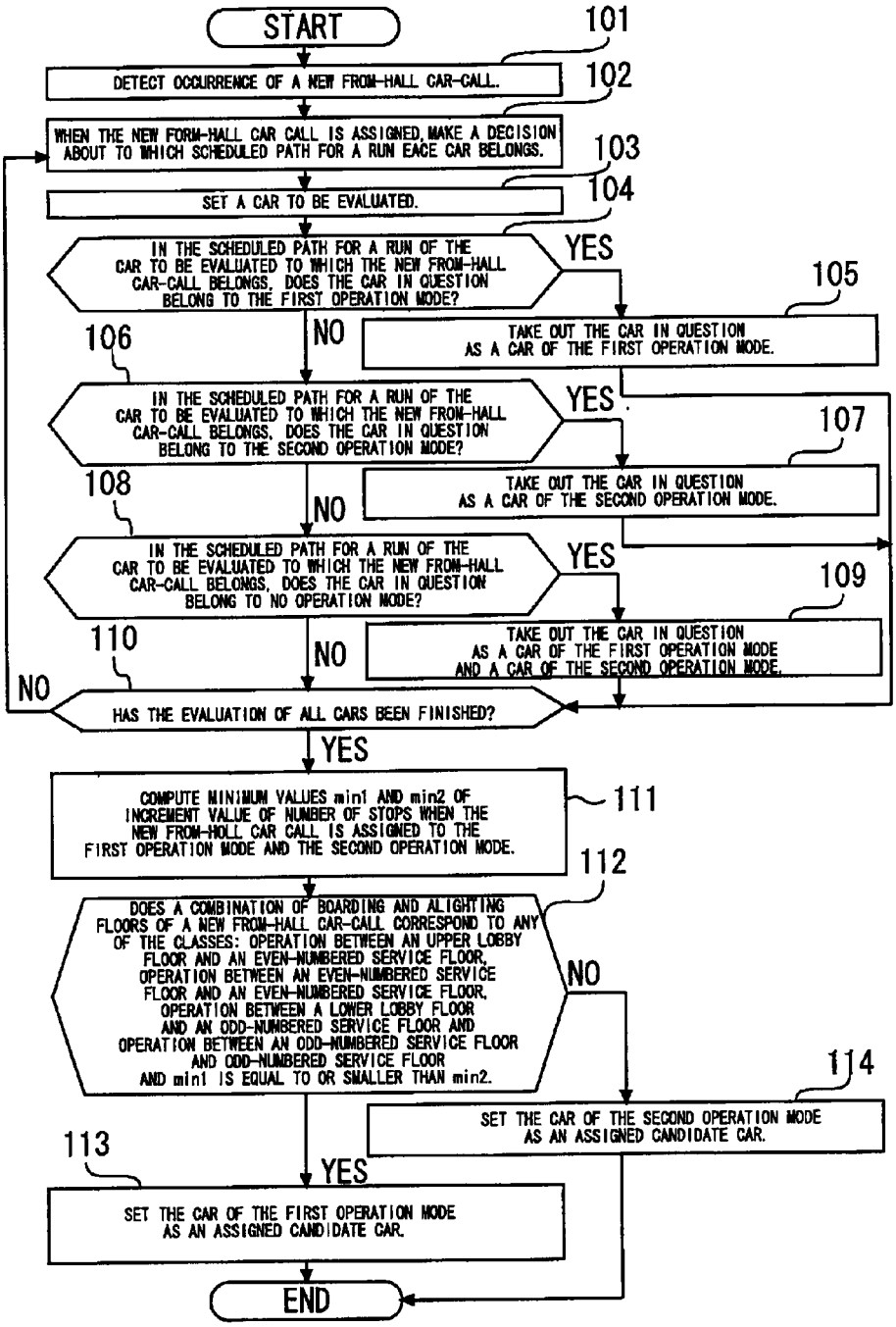
FIG. 3 shows the flow of the selection of assigned candidate cars in Embodiment 1 of the present invention.
Figure 4:
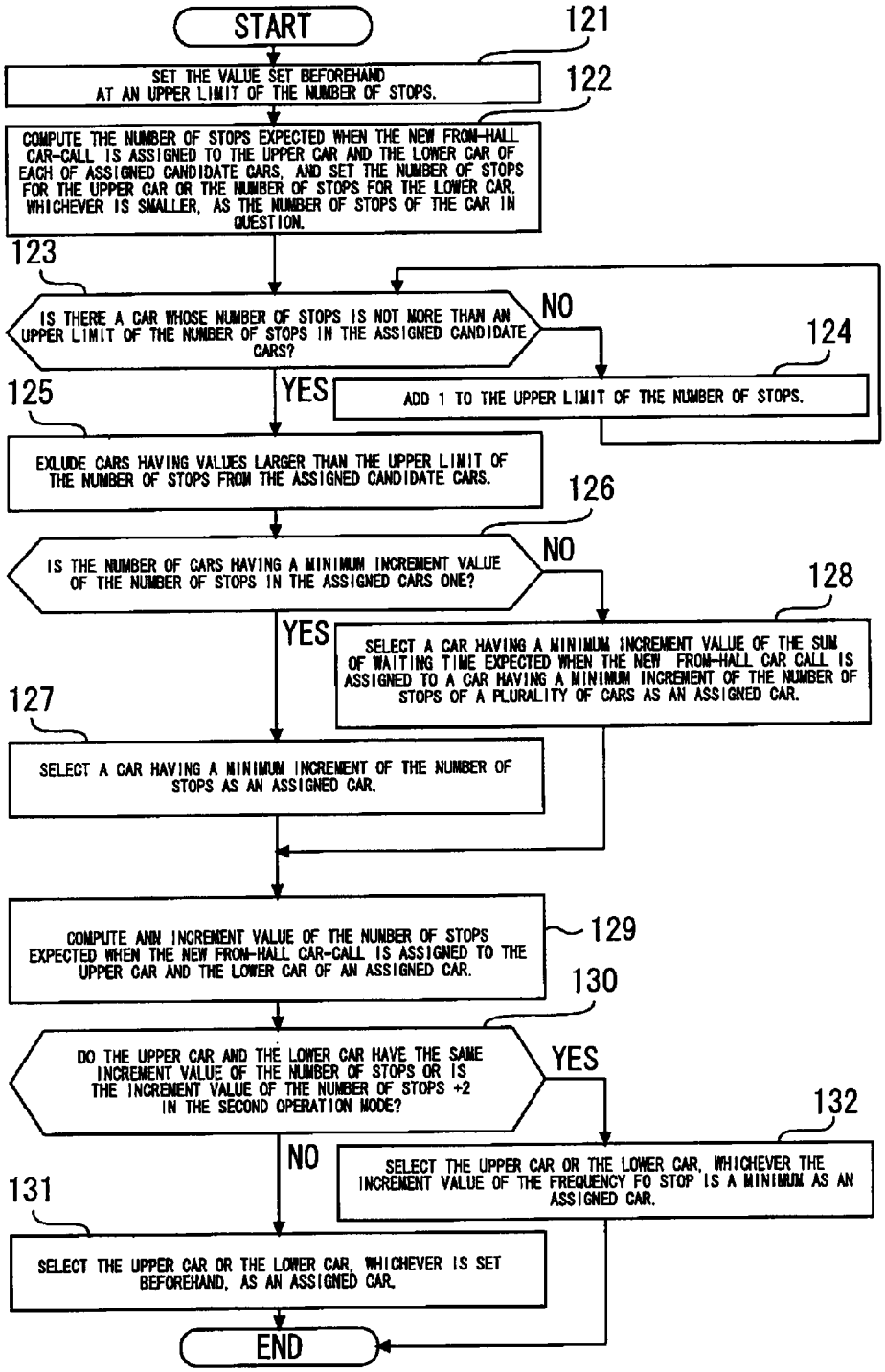
FIG. 4 shows the flow of the selection of assigned car in Embodiment 1 of the present invention.

Next, the operation of Embodiment 1 of the present invention will be described with the aid of the flowcharts of FIGS. 3 and 4. FIG. 3 shows the flow of processing until the selection of assigned candidate cars. In the flowchart of FIG. 3, first, in Step 101, the occurrence of a new from-hall car call is detected.

When in Step 102 after Step 101 the new from-hall car call is assigned, a decision is made about to which scheduled path for a run of the 1st path, the 2nd path and the 3rd path of each car the new from-hall car call belongs.

In Step 103 after Step 102, the first car to be evaluated is selected from all cars. In Step 104, determination is made as to whether in the scheduled path for a run of the car to be evaluated to which the new from-hall car call belongs, the car in question belongs to the first operation mode. In the case of YES in Step 104, in Step 105 the car in question is taken out as a car of the first operation mode.

In the case of NO in Step 104, determination is made in Step 106 whether in the scheduled path for a run of the car to be evaluated to which the new from-hall car call belongs, the car in question belongs to the second operation mode. In the case of YES in Step 106, in Step 107 the car in question is taken out as a car of the second operation mode.

In the case of No in Step 106, determination is made in Step 108 whether in the scheduled path for a run of the car to be evaluated to which the new from-hall car call belongs, the car in question belongs to neither the first operation mode nor the second operation mode. In the case of YES in Step 108, in Step 109 the car in question is taken out as a car of the first operation mode and the second operation mode.

In the case of NO in Step 108, in the case where the processing is finished after Step 105, in the case where the processing is finished after Step 107, and in the case where the processing is finished after Step 109, in Step 110 determination is made as to whether the evaluation of all cars has finished. In the case of NO in Step 110, the flow of processing returns to Step 103, where the next car is set as the car to be evaluated and the actions after Step 104 are repeated again. For example, when the number of cars is four, the action is started from Car 1, and is then carried out for Car 2, Car 3, and Car 4.

In the case of YES in Step 110, in Step 111 minimum values min1 and min2 of the increment value of the number of stops expected when the new from-hall car call is assigned to a car of the first operation mode and a car of the second operation mode, are computed.

In Step 112 after Step 111, determination is made as to whether a combination of boarding and alighting floors of a new from-hall car call corresponds to any of the classes: operation between an upper lobby floor and an even-numbered service floor, operation between an even-numbered service floor and an even-numbered service floor, operation between a lower lobby floor and an odd-numbered service floor and operation between an odd-numbered service floor and an odd-numbered service floor and as to whether min1 and min2 computed in Step 111 satisfy the condition min1≤min2. The condition min1≤min2 may be the condition min1<min2.

In the case of YES in Step 112, in Step 113 the car of the first operation mode is set as an assigned candidate car. In the case of NO in Step 112, in Step 114 the car of the second operation mode is set as an assigned candidate car.

Next, the operation performed in selecting an assigned car from the assigned candidate cars obtained in FIG. 3 will be described with the aid of the flowchart of FIG. 4. In Step 121 the value set beforehand is set at an upper limit of the number of stops. For example, the value of Formula (A) described earlier is used as an upper limit of the number of stops set beforehand.

Next, in Step 122 the number of stops expected when the new from-hall car call is assigned to the upper car and lower car of each of assigned candidate cars is computed, and the number of stops obtained when the assignment is made to the upper car or the number of stops obtained when the assignment is made to the lower car, whichever is smaller, is set as the number of stops of the car in question.

Next, in Step 123 determination is made as to whether the assigned candidate cars include a car whose number of stops is not more than an upper limit of the number of stops. In the case of NO in Step 123, in Step 124 one (1) is added to the upper limit value of the number of stops and the flow of processing returns to Step 123.

Next, in the case of YES in Step 123, in Step 125 cars having values of number of stops larger than the upper limit thereof are excluded from the assigned candidate cars. Next, in Step 126 determination is made as to whether the number of cars having a minimum increment value of the number of stops is one in the assigned candidate cars.

Next, in the case of YES in Step 126, in Step 127 the car having a minimum increment of the number of stops is selected as an assigned car. In the case of NO in Step 126, a car having a minimum increment value of the sum of waiting time expected when the new from-hall car call is assigned to a car having a minimum increment of the number of stops of a plurality of cars, is selected as an assigned car. Here, although a car having a minimum increment value of the sum of waiting time is regarded as an assigned car, a car having a minimum increment value of the total traveling time from the arrival at a hall to the alighting at a destination floor may also be regarded as an assigned car.

In Step 129 after Step 127 or Step 128, an increment value of the number of stops expected when the new from-hall car call is assigned to the upper car and lower car of an assigned car, is computed. Next, in Step 130 determination is made as to whether the upper car and the lower car have the same increment value of the number of stops or whether the assigned car is of the second operation mode or whether the increment value of the number of stops is +2. That the increment value of the number of stops is +2 corresponds to the fact that a boarding floor and an alighting floor have been newly added.

In the case of NO in Step 130, in Step 131 for the upper and lower cars which are assigned cars, the upper car is assigned if the upper car is set beforehand, and the lower car is assigned if the lower car is set beforehand. In the case of No in Step 130, in Step 132 the upper car or the lower car, whichever has a minimum increment value of the number of stops, is assigned.

Cars of the second operation mode are in charge of the movement between all of the floors at which the cars can stop, including the movement between an upper lobby floor and an odd-numbered floor and the movement between a lower lobby floor and an even-numbered lobby floor. However, it is possible to prohibit the movement between an upper lobby floor and an odd-numbered floor and the movement between a lower lobby floor and an even-numbered lobby floor also for the second operation mode. Furthermore, only in the case where a from-hall car call having attributes different from those of general passengers, such as the attributes of physically-handicapped persons and the attributes of VIPs (very important persons) is registered for from-hall car calls, the movement between an upper lobby floor and an odd-numbered floor and the movement between a lower lobby floor and an even-numbered lobby floor may be allowed also for the second operation mode.

In the double-deck elevator group controller configured like this, there are provided the first operation mode in which the upper car is in charge of the movement between an upper lobby floor and an even-numbered floor as well as the movement between even-numbered floors, and the lower car is in charge of the movement between a lower lobby floor and an odd-numbered floor as well as the movement between odd-numbered floors, and the second operation mode in which the upper and lower cars are in charge of the movement between all of the floors at which the cars can stop, mainly the movement between an odd-numbered floor and an even-numbered floor, whereby the cars of the first operation mode and the cars of the second operation mode can take partial charge of the movement between arbitrary floors.

The cars of the second operation mode are in charge of not only odd-numbered floors and even-numbered floors, but also the movement between all service floors. An increment value of the number of stops for the movement between even-numbered floors and the movement between odd-numbered floors is referred to, whereby it becomes possible to make a proper selection from both the cars of the first operation mode and the cars of the second operation mode, with the result that it is possible to increase the operation efficiency of the whole elevator system.

For example, a from-hall car call from 5F to 11F or from 6F to 12F is assigned to the cars of the second operation mode in which from-hall car calls from 5F to 8F and from 8F to 11F are assigned to the lower car, whereby it becomes possible to reduce the number of stops of the cars of the first operation mode without an increase in the number of stops of the cars of the second operation mode.

The set number of cars of the first operation mode and the set number of cars of the second operation mode for each scheduled path for a run of each car are changed according to the traffic flow types, such as an up-peak traffic flow with a heavy traffic in the ascending direction and a down-peak traffic flow with a heavy traffic in the descending direction, whereby it is possible to change the set number of cars of modes to be suitable for the traffic flow characteristics, with the result that it is possible to increase the whole operation efficiency.

An assigned car is selected from cars whose number of stops is not more than an upper limit of the number of stops among the cars of each operation mode, whereby it is possible to average the number of stops of each car and passengers who get on and off at the same service floor can be brought together. Therefore, it is possible to shorten the go-around time spent by a car in moving from a lobby floor to upper floors and returning to the lobby floor and to equalize the service to each floor, with the result that it is possible to increase the whole operation efficiency.

When the increment value of the number of stops is +2 in the cars of the second operation mode, the upper car or the lower car, whichever is set beforehand, is assigned without fail, whereby during the boarding and alighting of only the upper car or the lower car, which is the remainder of the above selection, it is possible to reduce the waiting action of passengers in the car without the occurrence of boarding and alighting. The fact that the increment of the number of stops is +2 corresponds to the fact that a boarding floor and an alighting floor have been newly added.

As described above, in the double-deck elevator group controller of the present invention, when a combination of boarding and alighting floors of a new from-hall car call corresponds to any one of the operation between an upper lobby floor and an even-numbered service floor, the operation between an even-numbered service floor and an even-numbered service floor, the operation between a lower lobby floor and an odd-numbered service floor and the operation between an odd-numbered service floor and an odd-numbered service floor and a minimum value of an increment of the number of stops obtained when a from-hall car call is assigned to a car of the first operation mode is not more than or less than a minimum value of an increment of the number of stops obtained when a from-hall car call is assigned to a car of the second operation mode, a car whose operation mode is the first operation mode is regarded as an assigned candidate car for the from-hall car call. Therefore, the double-deck elevator group controller of the present invention has the advantageous effect that the operation efficiency is increased.

And in the double-deck elevator group controller of the present invention, when a combination of boarding and alighting floors of a new from-hall car call corresponds to the operation between an even-numbered service floor and an odd-numbered service floor, or when a combination of boarding and alighting floors of a from-hall car call corresponds to the operation between an even-numbered service floor and an even-numbered service floor and the operation between an odd-numbered service floor and an odd-numbered service floor and a minimum value of an increment of the number of stops obtained when the from-hall car call is assigned to a car of the second operation mode is less than a minimum value of an increment of the number of stops obtained when the from-hall car call is assigned to a car of the first operation mode, a car whose operation mode is the second operation mode is regarded as an assigned candidate car for the above-described from-hall car call. Therefore, it is possible to provide service to a from-hall car call having an arbitrary floor as boarding and alighting floors and the double-deck elevator group controller of the present invention has the advantageous effect that the degree of freedom in car operation increases and the operation efficiency increases.

Furthermore, in the double-deck elevator group controller of the present invention, even when a combination of boarding and alighting floors of a new from-hall car call corresponds to either the operation between an upper lobby floor and an odd-numbered service floor or the operation between an lower lobby floor and an even-numbered service floor, a car whose operation mode is the second operation mode is regarded as an assigned candidate car for the above-described from-hall car call. Therefore, it is possible to provide service to a from-hall car call having an arbitrary floor as boarding and alighting floors and the double-deck elevator group controller of the present invention has the advantageous effect that that the degree of freedom in car operation increases and the operation efficiency increases.

Moreover, in the double-deck elevator group controller of the present invention, when at least either the number of passengers or the ratio of the number of passengers in the ascending direction who board cars from at least either an upper lobby floor or a lower lobby floor is not less than respective prescribed limited values or when a time zone set beforehand is matched, the number of cars on a path scheduled for a run in the ascending direction for which the first operation mode is set is increased in the above-described operation mode storage means. Therefore, the present invention has the advantageous effect that the degree of freedom in car operation increases and the operation efficiency increases.

In the double-deck elevator group controller of the present invention, at least either the number of passengers or the ratio of the number of passengers in the descending direction who alight from cars on at least either an upper lobby floor or a lower lobby floor is not less than respective prescribed limited values or when a time zone set beforehand is matched, the number of cars on a scheduled path for a run in the descending direction for which the first operation mode is set is increased in the above-described operation mode storage means. Therefore, the present invention has the advantageous effect that the degree of freedom in car operation increases and the operation efficiency increases.

And in the double-deck elevator group controller of the present invention, when a from-hall car call inputted by the above-described hall-installed car-call input device is assigned to an assigned candidate car of the first operation mode or the above-described second operation mode, cars whose number of stops on the scheduled path for a run to which the above-described from-hall car call belongs is not less than a prescribed upper limit or larger than the prescribed upper limit, are excluded from assigned candidate cars. Therefore, the present invention has the advantageous effect that the operation efficiency increases.

Furthermore, in the double-deck elevator group controller of the present invention, in assigned candidate cars obtained from the assigned candidate car selection means, cars whose increment value of the number of stops is small are preferentially selected as assigned cars when the from-hall car call inputted by the above-described hall-installed car-call input device is assigned, and in the case where there are plurality of cars having the same increment value of the number of stops, a car whose increment value of the sum of waiting time obtained when the from-hall car call is assigned or whose increment value of the sum of total travel time from the arrival at the hall to the alighting at the destination floor becomes a minimum is selected as an assigned car. Therefore, the present invention has the advantageous effect that the operation efficiency increases.

Moreover, in the double-deck elevator group controller of the present invention, when the assigned car selected by the assigned car selection means is a car of the second operation mode and the increment value of the number of stops by the above-described assigned car is 2, a prescribed car which is either the upper car or the lower car is assigned to the from-hall car call. Therefore, the present invention has the advantageous effect that the operation efficiency increases.

INDUSTRIAL APPLICABILITY

The present invention can be used in determining assigned cars of a group controller of a double-deck elevator in which upper and lower cars in a plurality of shafts are connected.

DESCRIPTION OF SYMBOLS

10A-C car call registration device,
11A-C machine number indication devices for from-hall car call,
20 elevator group controller,
21 operation mode storage means,
22 operation mode setting means,
23 traffic flow detection means,
24 means for changing the number of cars having a set operation mode,
25 from-hall car-call assigned candidate car selection means,
26 assigned candidate cars obtained from the assigned candidate car selection means,
27 assigned car selection means,
28 means for selecting assigned cars of the second operation mode,
30A-C each-car controller.

The invention claimed is:

1. A double-deck elevator group controller which controls the operation of a plurality of cars of an elevator system having cars vertically connected to each other in the same shaft, comprising:

a hall-installed destination floor input device which is installed in a hall of each floor, by use of which a passenger registers a from-hall car call by inputting his or her destination floor;

operation mode storage means which stores, for each car of the plurality of connected cars, two operation modes: a first operation mode in which an upper car of the connected cars serves an upper lobby floor and even-numbered service floors and a lower car of the connected cars serves a lower lobby floor and odd-numbered service floors and a second operation mode in which the upper car and lower car of the connected cars serve all floors at which the cars can stop; and from-hall car-call assigned candidate car selection means which, upon registration of a from-hall car call by the hall-installed destination floor input device, regards a car whose operation mode is the first operation mode as an assigned candidate car for the from-hall car call when a combination of boarding and alighting floors of the from-hall car call corresponds to any one of operation between an upper lobby floor and an even-numbered service floor, operation between an even-numbered service floor and an even-numbered service floor, operation between a lower lobby floor and an odd-numbered service floor and operation between an odd-numbered service floor and an odd-numbered service floor and a minimum value of an increment of the number of stops obtained when the from-hall car call is assigned to a car of the first operation mode is not more than or less than a minimum value of an increment of the number of stops obtained when the from-hall car call is assigned to a car of the second operation mode.

2. A double-deck elevator group controller which controls the operation of a plurality of cars of an elevator system having cars vertically connected to each other in the same shaft characterized by comprising:

a hall-installed destination floor input device which is installed in a hall of each floor, by use of which a passenger registers a from-hall car call by inputting his or her destination floor;

operation mode storage means which stores, for each car of the plurality of connected cars, two operation modes: a first operation mode in which an upper car of the connected cars serves an upper lobby floor and even-numbered service floors and a lower car of the connected cars serves a lower lobby floor and odd-numbered service floors and a second operation mode in which the upper car and lower car of the connected cars serve all floors at which the cars can stop; and from-hall car-call assigned candidate car selection means which, upon registration of a from-hall car call by the hall-installed destination floor input device, regards a car whose operation mode is the second operation mode as an assigned candidate car for the from-hall car call when a combination of boarding and alighting floors of the from-hall car call corresponds to operation between an even-numbered service floor and an odd-numbered service floor, or when a combination of boarding and alighting floors of the from-hall car call corresponds to operation between an even-numbered service floor and an even-numbered service floor and operation between an odd-numbered service floor and an odd-numbered service floor and a minimum value of an increment of the number of stops obtained when the from-hall car call is assigned to a car of the second operation mode is less than a minimum value of an increment of the number of stops obtained when the from-hall car call is assigned to a car of the first operation mode.

3. The double-deck elevator group controller according to claim 2, wherein in the from-hall car-call assigned candidate car selection means, even when a combination of boarding and alighting floors of the from-hall car call corresponds to either operation between an upper lobby floor and an odd-numbered service floor or operation between an lower lobby floor and an even-numbered service floor, a car whose operation mode is the second operation mode is regarded as an assigned candidate car for the from-hall car call.

4. The double-deck elevator group controller according to claim 1, further comprising means for changing the number of cars having a set operation mode which increases the number of cars on a scheduled path for a run in the ascending direction for which the first operation mode is set in the operation mode storage means when at least either the number of passengers or the ratio of the number of passengers in the ascending direction who board a car from at least either an upper lobby floor or a lower lobby floor is not less than respective prescribed limited values or when a time zone set beforehand is matched.

5. The double-deck elevator group controller according to claim 1, further comprising:

means for changing the number of cars having a set operation mode which increases the number of cars for which the first operation mode is set on a path scheduled for a run in the descending direction in the operation mode storage means when at least either the number of passengers or the ratio of the number of passengers in the descending direction who board cars from at least either an upper lobby floor or a lower lobby floor is not less than respective prescribed limited values or when a time zone set beforehand is matched.

6. The double-deck elevator group controller according to claim 1, further comprising:

means for selecting assigned candidate cars in terms of the number of stops which excludes cars whose number of stops on the scheduled path for a run to which the from-hall car call belongs is not less than a prescribed upper limit from assigned candidate cars when a from-hall car call inputted by the hall-installed destination floor input device is assigned to an assigned candidate car of the first operation mode or the second operation mode.

7. The double-deck elevator group controller according to claim 1, further comprising:

assigned car selection means which preferentially selects, in assigned candidate cars obtained from the assigned candidate car selection means, cars whose increment value of the number of stops is small as assigned cars when the from-hall car call inputted by the hall-installed destination floor input device is assigned, and selects, in assigned candidate cars obtained from the assigned candidate car selection means, a car whose increment value of the sum of waiting time obtained when the from-hall car call is assigned or whose increment value of the sum of total traveling time from the arrival at the hall to the alighting at the destination floor becomes a minimum as an assigned car in the case where there are plurality of cars having the same increment value of the number of stops.

8. The double-deck elevator group controller according to claim 7, further comprising:

means for selecting assigned cars of the second operation mode which assigns the from-hall car call to a prescribed car which is either the upper car or the lower car when the assigned car selected by the assigned car selection means is a car of the second operation mode and the increment value of the number of stops by the above-described assigned car is 2.

* * * * *